United States Patent [19]

Abbaschian

[11] Patent Number: 4,565,571

[45] Date of Patent: Jan. 21, 1986

[54] METHOD FOR PRODUCING LOW DENSITY POROUS METALS OR HOLLOW METALLIC SPHERES

[75] Inventor: Gholamreza J. Abbaschian, Gainesville, Fla.

[73] Assignee: University of Florida, Gainesville, Fla.

[21] Appl. No.: 534,655

[22] Filed: Sep. 22, 1983

[51] Int. Cl.[4] ..... C22B 4/00

[52] U.S. Cl. ..... 75/0.5 C; 75/10 R; 75/20 F; 156/DIG. 2; 164/467; 164/498; 219/7.5; 264/10

[58] Field of Search ..... 75/20 F, 10 R, 0.5 C; 156/DIG. 62; 219/7.5; 164/147.1, 467, 498, 503; 264/10; 428/570

[56] References Cited

U.S. PATENT DOCUMENTS

| | | | |
|---|---|---|---|
| 2,686,864 | 8/1954 | Wroughton et al. | 75/10 R |
| 4,021,167 | 5/1977 | Nagoya et al. | 425/7 |
| 4,162,914 | 7/1979 | Cremer | 75/0.5 C |

FOREIGN PATENT DOCUMENTS

| | | | |
|---|---|---|---|
| 128501 | 10/1980 | Japan | 428/570 |

*Primary Examiner*—Melvyn J. Andrews
*Attorney, Agent, or Firm*—Kerkam, Stowell, Kondracki & Clarke

[57] ABSTRACT

Disclosed are methods, utilizing electromagnetic levitation, for producing low density, porous metal structures and hollow metallic spheres, using particulate material as a starting point. As an initial step, a porous article of sufficient green strength to be substantially self-supporting is formed of a particulate material containing at least one electrically-conductive metal. The green porous article is subjected to an electromagnetic field which has a field strength and frequency sufficient to levitate the green article in space against the force of gravity, and which has a frequency sufficient to induce in the article an eddy current of such intensity to produce heat sufficient to melt the electrically conductive metal, thereby entrapping the pores of the green article and any gases or non-electrically conductive particulate material contained therein. The next steps vary, depending on whether a porous metal structure or a hollow metallic sphere is to be produced. For producing a porous metal structure, the article is cooled at a rate sufficient to solidify the molten metal and produce a low density porous metal structure containing pores which contain any entrapped gases or non-electrically conductive particulate material. For producing a hollow metallic sphere, the heating of the molten article is continued for a time sufficient to expand any gas contained in the pores to a volume such that substantially all of the entrapped pores combine to produce a hollow molten metal sphere, and then the sphere is cooled to solidify the molten metal.

24 Claims, 7 Drawing Figures

METHOD FOR PRODUCING LOW DENSITY POROUS METALS OR HOLLOW METALLIC SPHERES

BACKGROUND OF THE INVENTION

The invention described and claimed herein was made in the course of Contract NOOO14-81-K-0730, awarded by the Office of Naval Research.

Low density, porous metals and metal alloys may be substituted for high density metals in numerous applications resulting in materials and cost savings and/or weight reduction. Typical of such applications are self-lubricating bearings, lightly loaded gears, porous nickel plates for alkaline batteries, fuel cell electrodes, friction materials for clutches and brakes, low density ball bearings, etc. [See, e.g., Tracey et al, *Electrochemical Technology,* Vol. 3, pp. 17–25 (1965)].

Hollow metal spheres find applications as high gain fusion targets in nuclear-fusion technology, low density ball bearings and other areas. [See, e.g., Lee et al, *Proceedings of the Materials Research Society Annual Meeting,* Nov. 1981, Boston, Ma., pp. 95–104; Lee et al, ibid, pp. 105–113].

Porous metals may be produced by loose sintering (i.e., bonding of adjacent surfaces of particles by heating) of powder compacts, sintering of dried powder slurries, and/or sintering of compacts made of a mixture of metal powder with a pore-forming material. The formation of the bond is achieved by one or a combination of a variety of processes: viscous or plastic flow, evaporation and condensation, volume diffusion, and surface diffusion. In general, no bulk melting takes place during sintering. Sintering techniques generally result in the production of medium-to-high density materials. Since the pore volume in the final material is usually the same or less than the pore volume in the green compacts prior to sintering, the techniques are not applicable for the production of low-density materials. Furthermore, due to limited contact area between the powder particles, the strength of sintered materials is generally low.

A variety of other methods have been proposed for preparing metallic structures containing voids or pores.

U.S. Pat. No. 3,592,628 discloses a method for making foamed metals in zero gravity. This method, however, suffers from the disadvantage that it is limited to a zero-gravity environment.

U.S. Pat. No. 4,099,961 discloses a process for making foamed metal structures by melting a mass of metal having entrapped gas pockets, heating to expand the gas pockets and cooling to below the melting point of the metal. This procedure has not found wide application, however, since it is limited to sputtering techniques and to the use of intert gases such as Ar. It is also applicable only to the production of thin samples. Attempts to produce thick samples result in the escape of bubbles during melting. It can also only be used for metals from which a body containing entrapped gas can be prepared by sputtering. It is not applicable to bulk samples or for the preparation of spheres.

The technique presently being used to produce metallic spheres is to solidify free falling metallic bubbles which are produced via Rayleigh instability of an annular liquid jet. This technique has been used to produce small tin spheres, i.e., 2 mm in diameter. However, it is difficult to utilize this process to make spheres from other metals or to produce larger spheres.

U.S. Pat. No. 4,162,914 discloses a process for manufacturing hollow metal microballoons involving the formation of finely divided metal powder, introducing the powder into a plasma arc to melt the powder, diffusing into the molten particles a gas which inflates the molten particles and cooling the expanded particles. This method is limited to the production of microballoons and to metals which absorb hydrogen gas when liquid and desorb the gas when solid.

All of the aforedescribed methods for producing hollow spheres or porous metals suffer from one or more disadvantages.

It is an object of the present invention to provide novel methods for the production of low density, porous metals and metal alloys, and hollow metallic spheres which do not suffer from the disadvantages noted above.

SUMMARY OF THE INVENTION

According to the present invention, there is provided a method for the production of a low density, porous metallic structure comprising:

(a) forming from a particulate material containing at least one electrically conductive metal a porous article of sufficient green strength to be substantially self-supporting.

(b) subjecting the green porous article to an electromagnetic field which (i) has a field strength and frequency sufficient to exert a force in a direction such that the force of gravity acting on the green article is counterbalanced thereby levitating it in space, and (ii) has a frequency sufficient to induce an eddy current in the article of such intensity that the dissipation thereof produces sufficient heat to melt the electrically conductive metal, thereby entrapping the pores of the green article and any gases or non-electrically conductive particulate material contained therein, and (c) cooling the article at a rate sufficient to solidify the molten metal and produce a low density, porous metal structure containing pores which contain any entrapped gases or non-electrically conductive particulate material.

Optionally, the molten article (step b) containing entrapped pores may be heated for a longer period of time to expand the gas pores and lessen the density of the foamed metal.

The present invention also provides a method for the production of a porous metallic sphere comprising:

(a) forming from a particulate material containing at least one electrically conductive metal a porous article of sufficient green strength to be substantially self-supporting, (b) subjecting the green porous article to an electromagnetic field which (i) has a field strength and frequency sufficient to exert a force in a direction such that the force of gravity acting on the green article is counterbalanced thereby levitating it in space, and (ii) has a frequency sufficient to induce an eddy current in the article of such intensity that the dissipation thereof produces sufficient heat to melt the electrically conductive metal, thereby entrapping the pores of the green article and any gases or non-electrically conductive particulate material contained therein, (c) continuing the heating of the molten article for a time sufficient to expand any gases contained in the pores to a volume such that substantially all of the entrapped pores combine to produce a hollow molten metal sphere, and (d) cooling the sphere to solidify the molten metal thereby forming a hollow metal sphere.

DETAILED DESCRIPTION OF THE INVENTION

The above-described electromagnetic levitation melting technique is described in detail in "Techniques of Metals Research", Vol. 1, Part 2, Bunshah, Ed. Interscience Publishers, 1968, p. 801–832 and the literature references cited therein, the disclosures of all of which are incorporated herein by reference. Practical applications of electromagnetic levitation to date, however, have been confined to the melting and casting of metals in situations requiring the rigorous exclusion of impurities. The present invention is predicated on the discovery of a technique for utilizing electromagnetic levitation to produce heretofore unobtainable low density, porous metal structures and hollow metallic spheres.

The starting material comprises a porous article of sufficient green strength to be self-supporting formed from a particulate material containing at least one electrically conductive metal. The green article may be formed according to any known technique, e.g., cold compaction, etc. The particulate material may contain in addition to the electrically conductive metals, a non-conductive metal or material, e.g., alumina, silicon carbide, silica, glass, oxides, other carbides, nitrides, borides, ceramics, carbon, graphite powders, chopped fibers, or whiskers, silicon, boron, etc.

Suitable conductive metal or alloy powders include iron, copper, nickel, chromium, aluminum, titanium, silver, gold, tin, lead, steel, cast iron, brass, bronze, nickel alloys, etc., it being understood that any electrically conductive metallic material or mixture thereof may be employed. Generally, however, the mixture should contain at least about 40% by weight of conductive material in order to achieve levitation.

Upon melting and solidification of the compact the pores of the resulting continuous metallic matrix will contain the non-conductive material and/or non-metal particles entrapped therein.

The green compact may be formed in a partial or substantially complete vacuum or in an atmosphere of any desired gas or gaseous mixture. Control of the atmosphere during the formation of the starting material will result in a porous metal structure containing any desired gas entrapped therein or one containing little or no entrapped gas. Suitable such gases include air, $O_2$, $H_2$, $N_2$, He, Ar, $Cl_2$, $SO_2$, $H_2O$, CO, $CO_2$, deuterium, complex organic and inorganic gases, solids or liquids which vaporize upon heating.

The strength and frequency of the electromagnetic levitation field is selected so as to strike a suitable balance between the force necessary to achieve levitation and that necessary to produce sufficient heat to melt the conductive metal and controllably expand the pores of the structure to achieve the desired density. Those skilled in the art will be aware that the selection of field strength and frequency in any particular application will depend upon the particular conductive metal and amount thereof employed in the formation of the green starting article, as well as the nature of the remainder of the components thereof. In the examples which follow, a 10 KW, 400 Kc frequency generator was used. Other higher or lower frequency generators can also be used, however. Higher frequency fields will induce more heating but less levitation force. Lower frequency fields will have the opposite effect. The power level used in the following examples was 4 to 7 KW, depending on the sample. Those skilled in the art will recognize that a larger field strength is necessary to levitate and melt larger samples.

The duration of time during which the article is levitated, melted and expanded will also depend on the nature of the materials employed and the density and porosity characteristics of the desired final product.

The method of the invention can be used to produce low density-porous metals or alloys and/or hollow metallic spheres. During the rapid melting, the sample goes successively through several stages: (1) The metal melts from its surface and entraps the gases and/or non-conductive material that existed in the pores of the original compact, (2) the gases, entrapped in individual pockets, expand as a result of heating, and increase the volume of the material, (3) the entrapped gas pockets combine to form a single bubble inside the metal, and (4) the bubble finally collapses, resulting in a full density metal. Cooling of the sample in the first and second stages results in a porous, low density structure, while cooling in the third stage results in a hollow sphere. Porosities between 0 and about 85% may be obtained according to the method of the invention.

Cooling may be achieved by quenching in a suitable medium, e.g., oil, water, etc., or by allowing the article to remain at ambient temperature after levitation. Alternatively, the electromagnetic field may be adjusted, after expansion of the pores, to a strength sufficient to maintain the article in a state of levitation, but insufficient to maintain the temperature thereof at a level above the melting point for a time sufficient to result in solidification of the article. The molten metal can also be solidified while levitated by passing a stream of cooling gas around it.

Where a hollow sphere is produced, the cavity within the sphere will not be perfectly concentric where inertial effects are permitted to act on the molten sphere during solidification. For example, where the molten sphere is allowed to drop into a quenching medium, the effect of inertia on the structure will result in a non-concentric cavity during solidification. Allowing solidification to take place in a low-g condition, such as in drop tubes, the zero gravity of outer space, or while levitated until cooled, will result in a structure having a concentric cavity.

DESCRIPTION OF DRAWINGS AND PREFERRED EMBODIMENT

FIG. 1 is a three dimensional, perspective view of an electromagnetic levitation apparatus suitable for carrying out the method of the invention.

FIGS. *2a–2d* are photomicrographs of samples during the various stages of electromagnetic levitation and melting.

Figure 1:
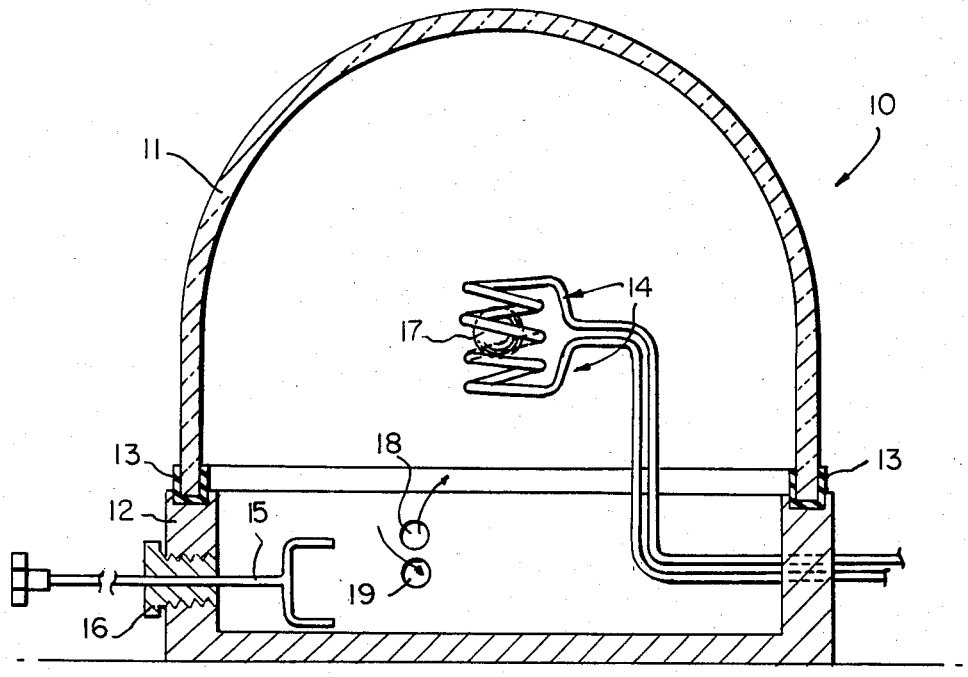

The electromagnetic levitation apparatus of FIG. 1 comprises a vacuum bell jar system 10 comprising a glass dome 11 removably sealed to the base portion 12 with gasket 13 and containing a levitation coil 14, powered by a voltage supply, not shown, a manipulator arm 15 movably mounted via packing screw 16 for positioning the sample pellet 17 within the coil, gas inlet means 18 and outlet means 19 for injecting gases and creating vacuum conditions within the system, and an oil quenching medium, not shown, located directly beneath the levitation coil. The coil consists of a copper tube wound to have a gap between the upper and the lower turns with the upper section wound in reverse direction to the lower. The coil in the examples which follow is powered by a 400 KC, 10 KW high frequency generator. The chamber is flushed with an inert gas (argon) or any other gas, if desired, in order to prevent oxidation. The chamber may be operated at one atmosphere pressure, partial or high vacuum.

The invention is illustrated by the following non-limiting examples:

EXAMPLE 1

Figure 2:
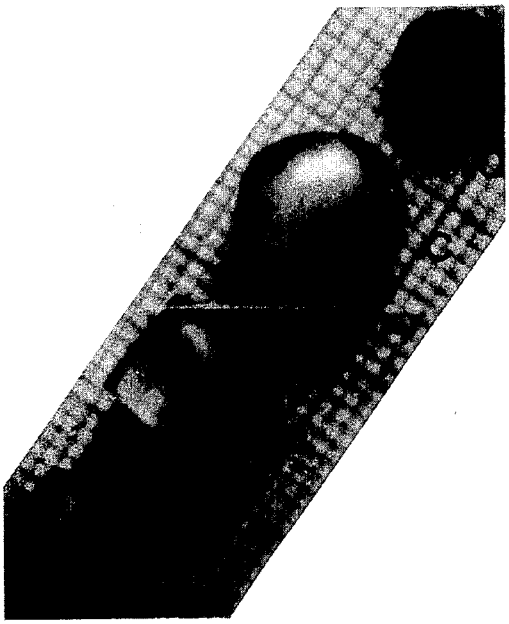

A sample, weighing about one gram, was prepared from metal powders (50 wt. % Cu and 50 wt. % Fe) by cold compaction into a cylindrical shape, as shown in FIG. 2*a*. The sample was then placed on a ceramic pedestal positioned on the manipulator arm beneath the coil of the levitation apparatus depicted in FIG. 1. After closing the chamber, the coil was powered (4∝7 KW) to levitate the sample. The pedestal may be removed at any time following levitation.

Figure 3:
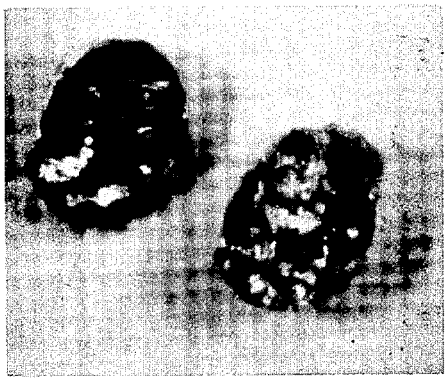
FIG. 3 is a photomicrograph of a cross-section of the sample of FIG. *2b*.

During rapid melting of the compact, the shape and volume of the levitated sample changed rapidly as shown in FIGS. 2*a–d*. In FIG. 2*a* the original compact is shown prior to the levitation. FIG. 2*b* shows the sample which was quenched immediately after melting. At this stage, the gases are entrapped and expanded by the heat. The sample at this stage is porous and is a low density-porous material. The apparent density of the sample shown in FIG. 2*b* is 4.9 g/cm$^3$ or 58% of the theoretical density, i.e., it contains 42% porosity. The microstructure of a cross-section of another sample produced under similar conditions is shown in FIG. 3. The matrix has a continuous network, i.e., the pores are mostly closed, and some pores have collapsed to form layer cavities.

Figure 4:
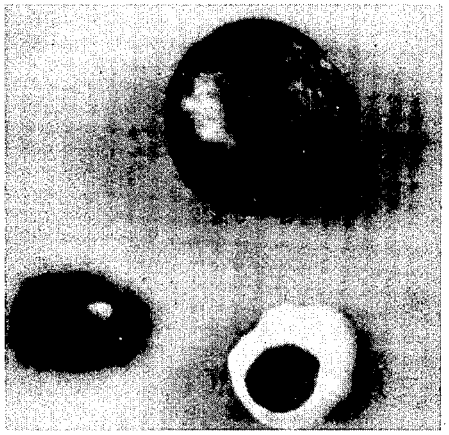
FIG. 4 is a photomicrograph of a cross-section of the sample of FIG. *2c*.

If the sample is held at the levitated state longer, most of the pores combine with each other, forming a large pore inside the metal shell. The sample at this stage becomes spherical in shape as shown in FIG. 2*c*. Due to the expansion of the entrapped gases the volume also increases. The density of the sample shown in this figure is 3.6 g/cm$^3$ or 43% of the theoretical density thus containing 57% porosity. The cross-section of another sphere produced similarly to that of FIG. 2*c* is shown in FIG. 4. A large cavity inside the sample can be seen. The cavity is not concentric due to the effect of gravity during solidification. The sphere may contain a single cavity or several gas pockets distributed inside the sample.

If the sample is held at the levitated state longer, the cavity collapses, resulting in a fully dense material, as shown in FIG. 2*d*. The density at this stage is about 8.4 g/cm$^3$.

EXAMPLE 2

A nickel sphere was prepared according to the method of Example 1 utilizing 6 KW power in an argon atmosphere. Levitation was maintained for 5 seconds before quenching in oil. The resulting sphere weighed 1.39 g and was 1.2 cm in diameter. The density of the sphere was 1.45 g/cm$^3$ (the density of pure, solid nickel in 8.9 g/cm$^3$). The sphere had a porosity of 83%.

I claim:

1. A method for the production of a low density, porous metallic structure comprising:

(a) forming from a particulate material containing at least one electrically conductive metal a porous article of sufficient green strength to be substantially self-supporting, (b) subjecting said green porous article to an electromagnetic field which (i) has a field strength and frequency sufficient to exert a force in a direction such that the force of grvity acting on said green article is counterbalanced thereby levitating it in space, and (ii) has a frequency sufficient to induce an eddy current in said article of such intensity that the dissipation thereof produces sufficient heat to melt said electrically conductive metal, thereby entrapping the pores of said green article and any gases or non-electrically conductive particulate material contained therein, and (c) cooling said article at a rate sufficient to solidify said molten metal and produce a low density, porous metal structure containing pores which contain any entrapped gases or non-electrically conductive particulate material.

2. The method of claim 1 wherein said levitated molten article is heated for a time sufficient to expand any gases contained in said entrapped pores to a desired volume while maintaining the integrity of said pores.

3. The method of claim 1 or 2 wherein said cooling is achieved by quenching.

4. The method of claim 1 or 2 wherein said cooling is achieved by allowing said molten article to fall in space until substantially completely solidified.

5. The method of claim 1 or 2 conducted under low gravity or in free-fall.

6. The method of claim 1 or 2 wherein said particulate starting material contains a non-electrically conductive material selected from the group consisting of a metal, a non-metal or mixtures thereof.

7. The method of claim 6 wherein said non-electrically conductive material is carbon, silicon, boron, alumina, silicon carbide, silica, a nitride or boride.

8. The method of claim 6 wherein said non-electrically conductive material is in the form of chopped fibers or whiskers.

9. The method of claim 1 or 2 wherein said green article is formed by compaction.

10. The method of claim 1 or 2 wherein steps (a) and (b) are conducted substantially in a vacuum whereby said entrapped pores are substantially devoid of gases.

11. The method of claim 1 or 2 wherein steps (a) and (b) are conducted in an atmosphere comprising air, $O_2$, $H_2$, $N_2$, He, Ar, $Cl_2$, $SO_2$, $H_2O$, CO, $CO_2$, deuterium, complex organic or inorganic gases or vaporized solids or liquids whereby said entrapped pores contain said gas.

12. The method of claim 1 or 2 wherein said cooling is achieved by adjusting the strength of said electromagnetic field to a value sufficient to maintain levitation of said article but insufficient to maintain the temperature thereof above the melting point of said electrically conductive metal.

13. A method for the production of a porous metallic sphere comprising:

(a) forming from a particulate material containing at least one electrically conductive metal a porous article of sufficient green strength to be substantially self-supporting, (b) subjecting said green porous article to an electromagnetic field which (i) has a field strength and frequency sufficient to exert a force in a direction such that the force of gravity acting on said green article is counterbalanced thereby levitating it in space, and (ii) has a frequency sufficient to induce an eddy current in said article of such intensity that the dissipation thereof produces sufficient heat to melt said electrically conductive metal, thereby entrapping the pores of said green article and any gases or non-electrically conductive particulate material contained therein, (c) continuing the heating of said molten article for a time sufficient to expand any gases contained in said pores to a volume such that substantially all of said entrapped pores combine to produce a hollow molten metal sphere, and (d) cooling said sphere to solidify said molten metal thereby forming a hollow metal sphere.

14. The method of claim 13 wherein said cooling is achieved by quenching.

15. The method of claim 13 wherein said cooling is achieved by allowing said molten article to fall in space until substantially completely solidified.

16. The method of claim 13 conducted under low gravity or in free-fall.

17. The method of claim 13 werein said particulte starting material contains a non-electrically conductive material selected from the group consisting of a metal, non-metal or mixture thereof.

18. The method of claim 17 wherein said non-electrically conductive material is carbon, silicon, boron a boride or nitride.

19. The method of claim 18 wherein said non-electrically conductive material is in the form of chopped fibers or whiskers.

20. The method of claim 13 wherein said green article is formed by compaction.

21. The method of claim 13 wherein steps (a), (b) and (c) are conducted substantially in a vacuum whereby said entrapped pores are substantially devoid of gases.

22. The method of claim 13 wherein steps (a), (b) and (c) are conducted in an atmosphere comprising air, $O_2$, $H_2$, $N_2$, He, Ar, $Cl_2$, $SO_2$, $H_2O$, CO, $CO_2$, deuterium, complex organic or inorganic gases or vaporized solids or liquids whereby said entrapped pores contain said gas.

23. The method of claim 13 wherein said cooling is achieved by adjusting the strength of said electromagnetic field to a value sufficient to maintain levitation of said article but insufficient to maintain the temperature thereof above the melting point of said electrically conductive metal, or by passing a cooling gas stream around the sample while levitated.

24. The method of claim 1 or 13 wherein said cooling is achieved by passing a cooling gas around said article while levitated.

* * * * *

UNITED STATES PATENT AND TRADEMARK OFFICE

CERTIFICATE OF CORRECTION

PATENT NO. : 4,565,571

DATED : January 21, 1986

INVENTOR(S) : Gholamreza J. Abbaschian

It is certified that error appears in the above-identified patent and that said Letters Patent is hereby corrected as shown below:

Claim 1, line 8, correct the spelling of "grvity" to read --gravity--;

Claim 17, line 25, correct the spelling of "werein" to read --wherein--;

Claim 17, line 25, correct the spelling of "particulte" to read --particulate--.

Signed and Sealed this

*Twenty-second* Day of *April 1986*

[SEAL]

*Attest:*

DONALD J. QUIGG

*Attesting Officer*

*Commissioner of Patents and Trademarks*